United States Patent [19]

Tauschek

[11] 3,952,713

[45] Apr. 27, 1976

[54] VALVE ROTATOR

[75] Inventor: Max J. Tauschek, South Euclid, Ohio

[73] Assignee: TRW Inc., Cleveland, Ohio

[22] Filed: Apr. 23, 1975

[21] Appl. No.: 570,625

[52] U.S. Cl. ..... 123/90.3; 74/88; 137/331

[51] Int. Cl.[2] ..... F01L 1/32; F16K 29/00

[58] Field of Search ..... 137/330, 331; 123/90.28, 90.29, 90.3; 74/88

[56] References Cited

UNITED STATES PATENTS

| | | | |
|---|---|---|---|
| 2,397,502 | 4/1946 | Ralston | 123/90.3 |
| 2,662,511 | 12/1953 | Sward | 137/331 X |
| 3,717,132 | 2/1973 | Van Slooten | 123/90.3 |
| 3,890,943 | 6/1975 | Schonlau et al. | 123/90.3 |

*Primary Examiner*—Martin P. Schwadron
*Assistant Examiner*—Richard Gerard

[57] ABSTRACT

A rotator for a valve which is reciprocable along a longitudinal axis between open and closed positions and which is rotatable about such axis. The rotator includes a pair of parts movable axially and rotatably relative to one another along and about the longitudinal axis. Variable force applying means in the form of a spring urges the valve toward its closed position and also urges the pair of parts toward one another with forces which alternately increase and decrease in magnitude during opening and closing movement of the valve. The valve is rotated during axial movement thereof by relative rotation between the two parts which is produced by a plurality of shiftable elements located between the parts and movable along separate paths which are dimensioned and positioned so that all of such paths taken together have a total path length which is greater than the circumference of a reference circle drawn about the longitudinal axis and passing through the midpoints of the paths.

14 Claims, 5 Drawing Figures

VALVE ROTATOR

BACKGROUND OF THE INVENTION

This application pertains to the art of motion conversion mechanisms, and more particularly, to such a mechanism for converting axial movement into rotational movement. The mechanism of the present application is particularly applicable for use in rotating exhaust valves on internal combustion engines and will be particularly described with reference thereto. However, it will be appreciated that the invention has broader aspects and may be used for imparting rotation to reciprocating elements other than internal combustion engine valves.

Valve rotators of a known type include first and second parts mounted for movement relative to one another axially and rotatably along and about a longitudinal axis. One part has grooves defining paths with inclined ramps on which rollable balls are positioned for imparting relative rotation to the parts in response to relative axial movement of such parts. In previous arrangements of this type, the grooves usually have axes lying on the circumference of a circle about the longitudinal axis. As a result, contact loads between the balls and their mating part are confined to a relatively narrow track on the mating part. This causes high contact loads between the balls and the mating part so that surface fatigue and wear occur relatively rapidly within this narrow track. Such high contact loads and rapid wear can be minimized by positioning a separate part with a formed raceway between the balls and the mating part but this makes the rotator more expensive and complicated.

Another suggested arrangement for minimizing high contact loads, and reducing surface fatigue and wear, is disclosed in U.S. Pat. No. 3,717,132 issued Feb. 20, 1973, to Van Slooten. In the Van Slooten arrangement, the grooves along which the balls move are positioned so that the balls move both circumferentially and radially relative to the longitudinal axis. The radial component of movement spreads surface fatigue and wear over a substantially larger area of the mating part so that life of the rotator is prolonged. However, the paths along which the balls move in the Van Slooten arrangement are located at the outer periphery of the one part and have a very short length. The very short path length is required in the Van Slooten arrangement in order that a circumferential spring will act against the balls in all positions of their movement along the paths. Such short paths limit the amount of relative rotation which can occur between the two parts due to rolling movement of the balls, and also limit the radial area over which surface fatigue and wear occurs on the mating part. The number of balls and grooves which can be provided within a given periphery is also limited when the grooves are located at the outer periphery of the one part so it is not possible to further reduce surface fatigue and wear by providing reduced contact pressures between the balls and the mating part.

SUMMARY OF THE PRESENT INVENTION

A valve rotator of the type described has the ball paths positioned so that all of the paths together have a total path length which is greater than the circumference of a reference circle drawn about the longitudinal axis and intersecting the path midpoints.

In accordance with a preferred arrangement, the paths are arranged so that the circumferential component of ball movement is substantially greater than the radial component thereof.

The paths along which the balls move are preferably positioned so that radial lines from the longitudinal axis along and about which the two parts of the valve rotator move axially and rotatably intersect such path axes at the path midpoints at angles other than 90°. In other words, the axis of adjacent paths intersect one another at included obtuse angles facing toward the longitudinal axis.

In accordance with an important aspect of the invention, the paths are located so that they can be considered overlapped. This permits additional balls and paths of maximum length to be incorporated within a given periphery so that surface fatigue and wear are minimized by virtue of a larger number of balls with the resulting reduced contact pressures, and by virtue of maximum radial movement of the balls. With the paths along which the balls move having inner and outer ends respectively located nearest and farthest from the longitudinal axis, this is accomplished by arranging the paths so that the path axis of each path extending from the inner end thereof intersects an adjacent path axis intermediate the inner and outer ends of the adjacent paths, and preferably intersects the adjacent path axis at the midpoint thereof.

It is a principal object of the invention to provide an improved valve rotator which spreads contact loads over a larger area to reduce surface fatigue and wear, and, more specifically, it is a further object of the invention to arrange the ball paths so that the total length of all the paths is greater than the circumference of a circle passing through the path midpoints and having its center at the longitudinal axis about which the parts of the rotator move.

It is a further object of the invention to arrange the paths along which the balls move so that they are overlapped in order to provide a greater number of balls and total path length within a given periphery of a valve rotator.

BRIEF DESCRIPTION OF THE DRAWINGS

Further features of the present invention will be apparent to those skilled in the art from the following description made with reference to the accompanying drawings, in which.

DESCRIPTION OF A PREFERRED EMBODIMENT

Figure 1:
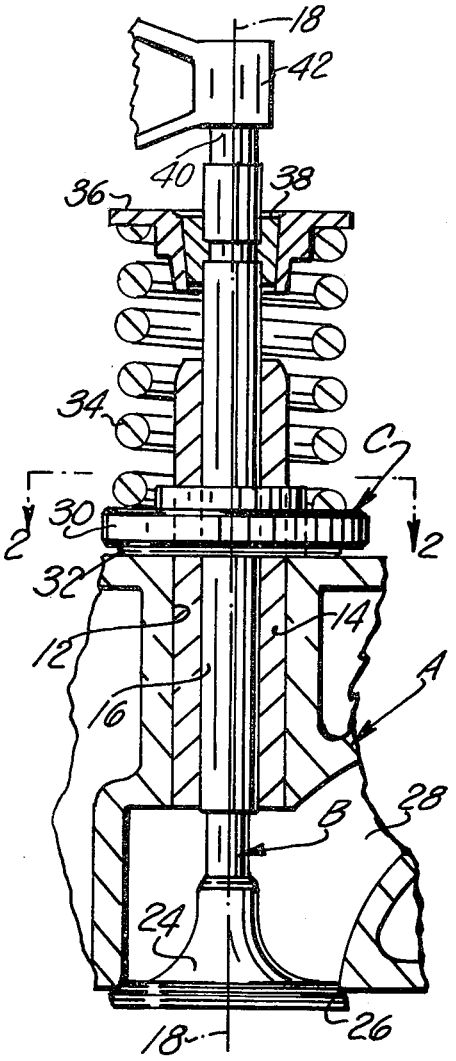
FIG. 1 is a cross-sectional view of a valve having an improved rotator of the present invention incorporated therein.

With reference to the drawing, FIG. 1 shows a portion of an engine cylinder head A having a bore 12 receiving a cylindrical guide sleeve 14 in which stem 16 of valve B is rotatably and reciprocatingly received for movement around and along longitudinal axis 18.

Valve B is shown with head 24 thereof in its closed position against valve seat 26 which surrounds an opening from a combustion chamber leading to an exhaust port 28.

Valve rotator C having first and second parts 30 and 32 is positioned around guide sleeve 14 with the second part 32 bearing against the outer surface of cylinder head A. A coiled valve spring 34 bears against valve rotator part 30 and against a valve spring retainer 36 which is locked to stem 16 against axial and rotational movement relative thereto by a locking member 38. Tip end 40 of valve stem 16 is acted upon by a rocker arm 42 which rocks down and up for respectively moving valve head 24 to an open position away from valve seat 26 and allowing movement of valve head 24 back to its closed position against valve seat 26 by the force of valve spring 34. Valve spring 34 comprises a variable force applying means for applying variable forces to valve B which alternately increase and decrease between minimum and maximum force values as valve B opens and closes.

In the valve-closed position shown in FIG. 1, valve spring 34 is expanded to its greatest extent and is applying a minimum force value. As rocker arm 42 rocks downwardly for moving valve head 24 away from seat 26, the force of valve spring 34 gradually increases until its maximum force value is reached when valve B is fully opened. The forces of the valve spring 34 also act against the first rotator part 30 for biasing the rotator part 30 toward the second rotator part 32 and firmly urging the second rotator part 32 into engagement with the outer surface of cylinder head A so that the second part 32 is fixed against rotation.

Figure 3:
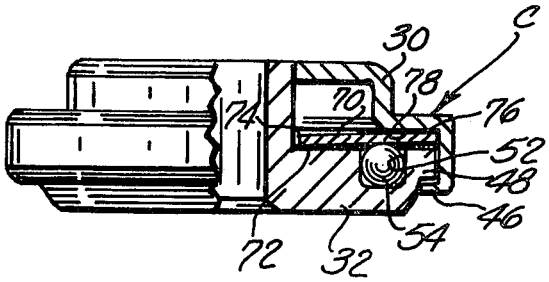
FIG. 3 is a partial cross-sectional elevational view looking generally in the direction of arrows 3—3 of FIG. 2.

The first and second rotator parts 30 and 32 are mounted for free movement rotatably and axially relative to one another about longitudinal axis 18. The first rotator part 30 has an inwardly extending flange portion 46 which cooperates with an outwardly extended flange portion 48 on second rotator part 32 for preventing axial separation of parts 30 and 32 which are shown generally in their maximum axially separated position in FIG. 3.

The second rotator part 32 has a plurality of individual and separate grooves 52 therein defining paths along which shiftable elements defined by spherical balls 54 move. Each groove has a shallow inner end 56 and a deeper outer end 58 respectively located nearest and farthest from longitudinal axis 18. The bottom of each groove or path 52 is inclined downwardly from shallow end 56 toward deeper end 58 to define an inclined ramp 60. A coil spring 64 is positioned in each groove 52 for normally biasing each ball 54 toward shallow inner end 56. Balls 54 have a diameter substantially greater than the depth of shallow inner ends 56 and may have a diameter less than the depth of deeper outer ends 58.

A belleville spring washer 70 is positioned between rotator parts 30 and 32 for applying a separating force to such parts tending to move same axially away from one another. Such separating force applied by spring washer 70 has a magnitude intermediate the minimum valve closed force applied by valve spring 34 and the maximum valve open force applied thereby. In the closed position of valve B, the inner bottom edge 72 of spring washer 70 bears against an upper surface 74 of rotator part 32, while upper outer surface 76 of spring washer 70 bears against surface 78 of rotator part 30.

When rocker arm 42 moves downwardly to move valve head 24 away from seat 26, the force of valve spring 34 increases so that the force applied by surface 78 of first rotator part 30 against upper outer portion 76 of spring washer 70 causes inner bottom surface 72 of such spring washer to move upwardly away from surface 74 of the second rotator part 32 to free the first rotator part 30 and spring washer 70 for rotation relative to the second rotator part 32. The shiftable elements defined by balls 54 then roll down ramps 60. During such rolling movement of balls 54, the firm engagement therebetween and spring washer 70, and the firm engagement between portion 76 of spring washer 70 and first rotator part 30, causes the first rotator part 30 to rotate in the direction of arrow 84 in FIG. 2 relative to the second rotator part 32. Due to the firm frictional engagement of valve spring 34 with the first rotator part 30 and spring retainer 36, this rotational movement is also imparted to valve B during opening movement thereof.

As rocker arm 42 moves upwardly for allowing valve head 24 to return to its closed position against valve seat 26 under the force of valve spring 34, inner bottom portion 72 of spring washer 70 again engages surface portion 74 of second rotator part 32 for preventing reverse relative rotation between the first and second rotator parts 30 and 32. The action of spring washer 70 in separating parts 30 and 32 as the force of valve spring 34 decreases from its maximum toward its minimum value also allows balls 54 to move back toward shallow ends 56 under the force of coil springs 64. This repetitive action successively rotates valve B for minimizing deterioration, wear and stress upon such valve.

Figure 2:
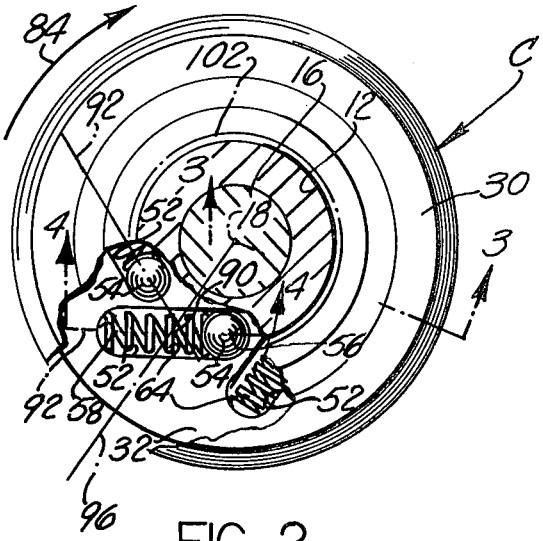
FIG. 2 is a plan view looking generally in the direction of arrows 2—2 of FIG. 1, and with portions omitted and other portions cut-away for clarity of illustration.

As best shown in FIG. 2, each groove or path 52 has a midpoint 90 between inner and outer ends 56 and 58 thereof. Each path also has a longitudinal path axis 92 which is preferably straight line. As shown in FIG. 2, a radial line 96 extending from longitudinal axis 18 intersects midpoint 90 at an angle other than 90°. In the preferred arrangement, grooves or paths 52 for the shiftable elements defined by balls 54 are arranged equidistantly and symmetrically about longitudinal axis 18, and are positioned so that the angle defined on one side of a path axis 92 and radial lines 96 is obtuse, and on the other side such angle is acute. With the paths 52 symmetrically positioned about axis 18, the circumference of a reference circuit 102 drawn about longitudinal axis 18 and extending through the midpoint 90 of each path has a circumference which is substantially less than the total path length of all paths 52 taken together. Shiftable elements or balls 54 move both inwardly and outwardly relative to circle 102 during operation of rotator C. As shown in FIG. 2, the intersection between adjacent axes 92 of paths 52 define obtuse angles facing toward longitudinal axis 18. In addition, in order that paths 52 may overlap one another, it is desirable that longitudinal axis 92 of each path extending from inner end 56 of such path intersects the adjacent actual path along which the adjacent shiftable element moves. Preferably, such intersection occurs at substantially the midpoint of the adjacent path.

Figure 5:
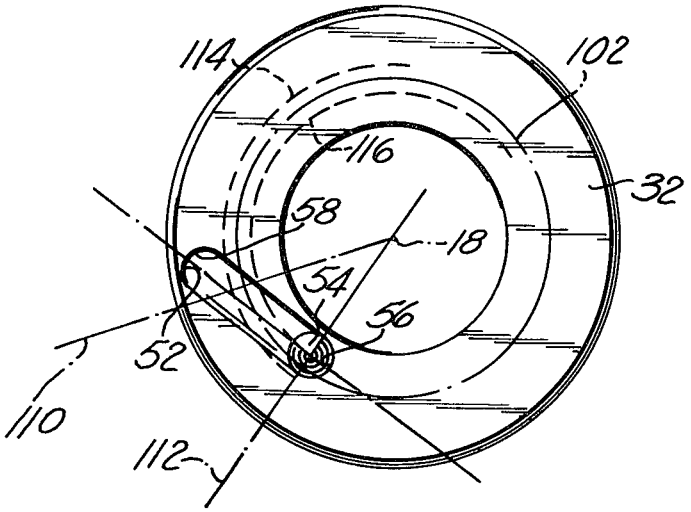
FIG. 5 is a diagrammatic plan illustration showing the relatively wide radial path along which the balls move in the improved rotator of the present invention.
Figure 4:
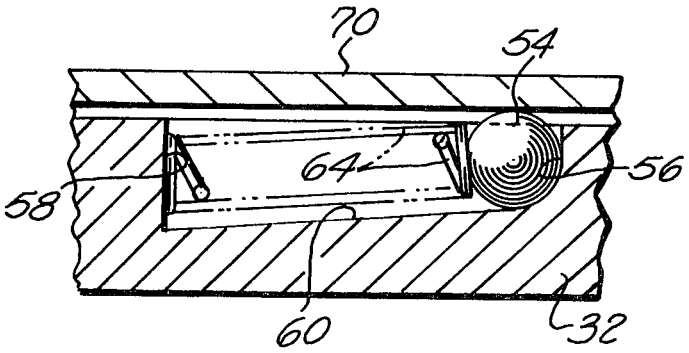
FIG. 4 is a cross-sectional elevational view looking generally in the direction of arrows 4—4 of FIG. 2.

FIG. 5 shows radial lines 110 and 112 from longitudinal axis 18 to indicate the circumferential component of movement of shiftable elements or balls 54 generally along reference circle circumference 102. Dotted circle lines 114 and 116 generally indicate the radial movement of balls 54 inwardly and outwardly relative to longitudinal axis 18. As shown in FIG. 5, the circumferential component of movement of balls 54 is substantially greater than the radial component of movement between lines 114 and 116 in order that substantial relative rotational movement is provided between rotator parts 30 and 32. However, it should be recognized that the radial component of movement between lines 114 and 116 is also substantial, and is only slightly less than the diameter of a ball 54. All of grooves or paths 52 along which balls 54 move are located completely and entirely within the outer periphery of second rotator part 32, and the overlapping arrangement of the paths as described minimizes the necessary size of the rotator while providing a maximum number of balls and ball paths.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

Having described my invention, I claim:

1. A mechanism for converting axial movement into rotational movement comprising; first and second parts mounted for movement relative to one another axially and rotatably along and about a longitudinal axis, a plurality of shiftable elements positioned between said parts for imparting relative rotational movement thereto during relative axial movement therebetween, each said shiftable element being shiftable along a path extending varying distances from said longitudinal axis and having a path midpoint, and all of said paths together having a total path length which is greater than the circumference of a reference circle drawn about said longitudinal axis and intersecting said path midpoints.

2. The mechanism of claim 1 wherein said paths have path axes, and radical lines from said longitudinal axis intersect said path axes at said midpoints at angles other than 90°.

3. The mechanism of claim 1 wherein said shiftable elements comprise balls positioned in grooves in one of said parts, said grooves having downwardly sloping bottoms and including shallow groove ends and deeper groove ends, and ball springs biasing said balls toward said shallow groove ends.

4. The mechanism of claim 1 and further including variable force applying means acting against one of said parts for applying forces which alternately increase and decrease between first and second force values for moving said one part toward said second part, and yieldable biasing means for applying separating force between said parts for moving said parts away from one another, said separating force having a magnitude intermediate said first and second force values.

5. The mechanism of claim 4 wherein said shiftable elements shift along said paths for imparting relative rotational movement to said parts during axial movement thereof toward one another.

6. The mechanism of claim 1 wherein said path axes are straight lines.

7. The mechanism of claim 1 wherein said path axes are non-aligned and said axes of adjacent paths intersect one another at included obtuse angles facing toward said longitudinal axis.

8. The mechanism of claim 1 wherein said paths are positioned to extend a substantially greater distance generally along the circumference of said reference circle than inwardly and outwardly of said circle.

9. The mechanism of claim 1 wherein said shiftable elements impart rotation to said first part relative to said second part and further including a valve reciprocable and rotatable along and about said longitudinal axis, variable force applying means for applying variable forces to said valve which alternately increase and decrease between minimum and maximum force values as said valve opens and closes, said variable force applying means acting on one of said parts for urging said one part toward the other of said parts, said shiftable elements being operative for imparting rotational movement to said first part during movement of said one part toward said other part as said force values increase from said minimum toward said maximum, and said first part being mounted for imparting rotational movement to said valve during rotation of said first part.

10. A rotator for a valve reciprocable between open and closed positions along a longitudinal axis and being rotatable about said axis, said rotator including first and second parts movable axially and rotatably relative to one another along and about said axis, variable force applying means for urging said valve toward said closed position and urging said parts toward one another with forces which alternately increase and decrease, a plurality of shiftable elements between said parts movable along separate paths for imparting relative rotation thereto during relative axial movement therebetween, said parts being mounted for imparting rotational movement to said valve during relative rotational movement between said parts, said paths having midpoints, a reference circle intersecting said midpoints and having a center coincidental with said longitudinal axis, said paths being positioned to have path components extending generally along said circle and path components extending both inwardly and outwardly of said circle from said midpoints, and all of said paths together having a total path length which is greater than the circumference of said circle.

11. The rotator of claim 10 wherein said path components extending generally along said circle are substantially greater than said path components extending generally inwardly and outwardly of said circle.

12. The rotator of claim 11 wherein said shiftable elements are for imparting relative rotational movement to said parts as said parts move toward one another during movement of said valve toward said open position, and said shiftable elements and paths are located completely within the outer periphery of said first and second parts.

13. The rotator of claim 10 wherein said paths have path axes and inner and outer ends respectively located nearest and farthest from said longitudinal axis, said path axis of each said path extending from said inner end thereof to intersection with the adjacent path axis intermediate said inner and outer ends of said adjacent path.

14. The rotator of claim 13 wherein said path axis of each said path extends from said inner end thereof to intersect the adjacent path axis substantially at the midpoint of said adjacent path.

* * * * *